US007354489B2

(12) United States Patent
Hofmann et al.

(10) Patent No.: US 7,354,489 B2
(45) Date of Patent: Apr. 8, 2008

(54) LEAD-FREE COPPER ALLOY AND A METHOD OF MANUFACTURE

(75) Inventors: Uwe Hofmann, Neu-Ulm (DE); Wolfgang Dannenmann, Langenau (DE); Andreas Boegel, deceased, late of Weissenhorn (DE); by Doris Humpenoeder-Boegel, legal representative, Weissenhorn (DE); Monika Breu, Ulm (DE); Guenter Schmid, Altenstadt (DE); Joerg Seeger, Ulm (DE)

(73) Assignee: Wieland-Werke AG, Ulm (DE)

( * ) Notice: Subject to any disclaimer, the term of this patent is extended or adjusted under 35 U.S.C. 154(b) by 564 days.

(21) Appl. No.: 10/788,037

(22) Filed: Feb. 26, 2004

(65) Prior Publication Data

US 2004/0234411 A1 Nov. 25, 2004

(30) Foreign Application Priority Data

Feb. 28, 2003 (DE) ..... 103 08 778

(51) Int. Cl.
*C22C 9/04* (2006.01)

(52) U.S. Cl. ..... 148/434; 420/477; 420/478; 420/479; 420/480; 420/481

(58) Field of Classification Search ..... 148/434; 420/477–481
See application file for complete search history.

(56) References Cited

U.S. PATENT DOCUMENTS 1,954,003 A 4/1934 Vaders
5,167,726 A 12/1992 LoIacono et al.
2002/0057985 A1 5/2002 Ling et al.

FOREIGN PATENT DOCUMENTS

| | | | |
|---|---|---|---|
| DE | 836 567 | | 5/1952 |
| DE | 43 18 377 | | 12/1993 |
| DE | 100 65 735 | | 10/2001 |
| EP | 0 572 959 | | 2/1997 |
| FR | 1 031 211 | | 6/1953 |
| GB | 350 750 | | 6/1931 |
| JP | 09143598 | * | 3/1997 |
| JP | 11001736 | * | 1/1999 |

OTHER PUBLICATIONS

Patent Abstracts of Japan: JP 09-143598 dated Jun. 3, 1997 (1 page).
Patent Abstracts of Japan: JP 09-316570 dated Dec. 9, 1997 (1 page).

* cited by examiner

*Primary Examiner*—Sikyin Ip
(74) *Attorney, Agent, or Firm*—Flynn, Thiel, Boutell & Tanis, P.C.

(57) ABSTRACT

A lead-free copper alloy based on Cu—Zn—Si and a method of manufacture thereof. The copper alloy is built on the basis of copper, zinc and silicon without toxic additives and consists of: 70 to 83% Cu, 1 to 5% Si and the further matrix-active elements: 0.01 to 2% Sn, 0.01 to 0.3% Fe and/or Co, 0.01 to 0.3% Ni, 0.01 to 0.3% Mn, the remainder Zn and unavoidable impurities.

14 Claims, 1 Drawing Sheet

LEAD-FREE COPPER ALLOY AND A METHOD OF MANUFACTURE

FIELD OF THE INVENTION

The invention relates to a copper alloy based on Cu—Zn—Si and a method of manufacture thereof.

BACKGROUND OF THE INVENTION

Brass is being utilized in different areas of mechanical engineering, electrical engineering and sanitation technology.

The components in mechanical engineering and in electrical engineering are becoming increasingly smaller and more filigree due to the trend toward miniaturization. Also, components of brass are often connected with other metallic and non-metallic materials to form complicated groups of components. However, both make a recycling of the materials based on a separation or division more difficult.

Further difficulties occur in particular when the components to be recycled contain toxic or health-threatening elements or substances. These can directly endanger the workers in a factory which produces and processes these materials. An environmental impact is created when these materials must be stored for a prolonged period of time and are thereby subjected to atmospheric influences. In addition, the toxic substances may contaminate the accessory agents, for example, the separating means, which are utilized during the preparation of shredder fractions via the sinking or floating method. An expensive waste disposal of the accessory agents would then be needed. Of course health-threatening substances and elements are also undesired during the use of the components if an emission into the environment or the living organism cannot be completely avoided.

Thus, a composition which is non-threatening with respect to ecological and toxic reasons is important for such products. The increased concerns about the environment, which can be found in many standards and technical controls, for example the re-enacted drinking-water regulation DIN 50930-6 or the scrap-material regulation, demands suitable materials.

The field of electrical engineering utilizes mainly Pb-containing brass as a contact material, namely as stationary contacts or solid contacts, part of which are, for example, clamping joints and plug connectors or connector contacts. When choosing the material, its easy processing stands in the foreground. The respective componentry can be manufactured with a high degree of productivity out of a machinable Pb-containing brass.

The Pb particles in the structure create disadvantages. The particles act as chip breakers and reduce the strength or ductility of the material due to a notching tendency and reduction of the load-bearing cross-section. These disadvantages must be compensated for by suitably dimensioning the component.

All fastening elements have, caused by their manufacture, a more or less inherently high mechanical stress. These are often superposed by tensile-load tensions which are caused by screw connections. When the clamping joints are manufactured out of common Pb-containing brass, there exists, due to such tensions, a great danger for tension stress corrosion cracking.

In addition, there also exists a need for ecologically compatible materials in the field of electrical engineering. Looking at the directives given by the European Parliament regarding the electrical and electronic apparatus used, it can be seen that, within a reasonably short period of time in the future, Pb will become an undesired alloy part. The goal of this initiative is, in this connection, to increase the portion of environmentally friendly materials in the material cycle.

Furthermore, components or containers for the transport or the storage of liquids are made out of Pb-containing brass. An important area is the sanitation technology. Negligence regarding the metal is especially particularly problematic here. The materials being used should thus be hardly susceptible to any type of corrosion. The components for the transport or the storing of liquids are as a rule manufactured by machining. A hot forming via die-forging often precedes.

These lead-containing brass alloys are known, for example, from the Reference DE 43 18 377 C2, which are used as a malleable or casting alloy in the optic industry, the jewelry industry and in the area of drinking water and sanitation installation. This alloy also achieves its good machining ability from an admixture of a considerable amount of lead.

The further development of easily machinable lead-free malleable alloys based on copper is known from the Reference DE 691 24 835 T2. The alloy is supposed to replace present lead-containing materials without changing the processing conditions. Instead of lead, bismuth and the elements phosphor, indium and tin are added in small amounts for this purpose to the alloy.

The basic purpose of the invention is to provide an improved lead-free copper alloy with respect to its characteristics and to set forth its use.

SUMMARY OF THE INVENTION

The purpose is attained by providing a copper alloy based on copper, zinc and silicon and consisting of: 70 to 83% Cu, 1 to 5% Si and the further matrix-active elements: 0.01 to 2% Sn, 0.01 to 0.3% Fe and/or Co, 0.01 to 0.3% Ni, 0.01 to 0.3% Mn, the remainder being Zn and unavoidable impurities.

The copper alloy contains selectively, in addition, up to 0.1% P and selectively each in addition up to 0.5% Ag, Al, As, Sb, Mg, Ti, Zr.

All parts of the alloy are disclosed in weight %.

BRIEF DESCRIPTION OF THE DRAWING

The invention will be discussed in greater detail in connection with the drawing, in which.

DETAILED DESCRIPTION

Figure 1:
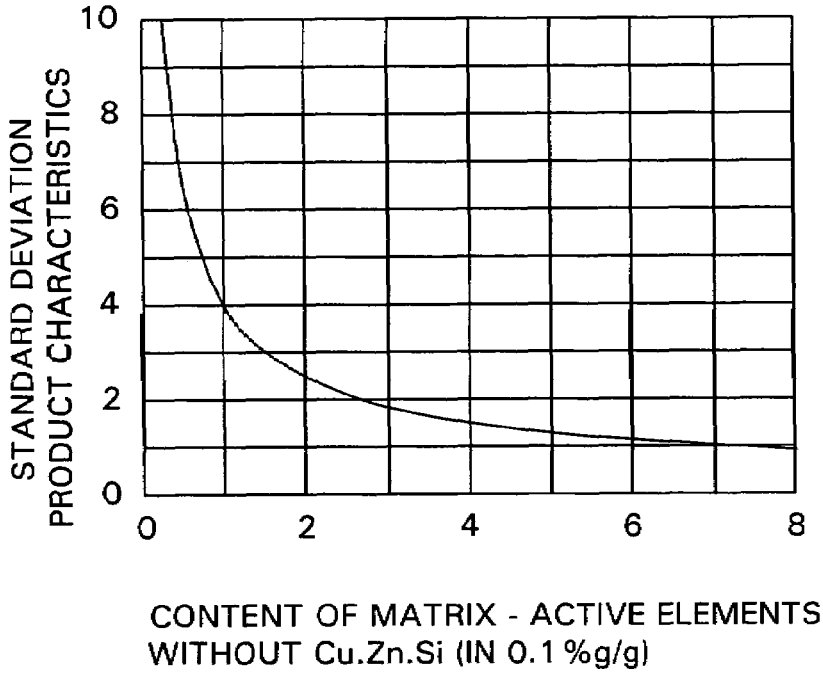
FIG. 1 illustrates the relationship between the standard deviations of the product characteristics and the content of matrix-active elements without majority components.

The invention is based on the premise that the suitable combination of the alloy elements and the characteristics resulting from a cooperation of the individual parts all together meet the expectations demanded from the alloy and thus the requirement for the material should be covered. The material should, for this purpose, at the same time be distinguished by the absence of toxic elements, a good machining property, a good workability, a high corrosion resistance, an increased strength level with an equally high ductility compared to lead-containing machinable brass, a capability for mass production in a mill for partially finished products, and a robust manufacture, namely, a manufacture not sensitive with respect to fluctuating operating parameters, in a mill for partially finished products.

The copper alloy is, for this purpose, designed as a Si-containing CuZn alloy (naval brass) without toxic additives. Naturally the demands for a health-conscious and ecological compatibility are thus met.

The Cu-content of the inventive alloy lies between 70% and 83%.

Cu-contents below 70% would lead to a brittleness, which would result in a significantly low ductile yield or impact bending resistance. For example, disadvantages in the non-cutting forming would be created through this. When the Cu-content exceeds 83%, long, bulky chips would be created during an uninterrupted cut of the machining process.

Analogous situations exist regarding the Si-content: In the case of Si-concentrations below 1%, the advantage of the short chips would be lost; above 5% the toughness would drop off too far.

Sn, Mn and Si are used to purposefully influence the structural constitution at a given copper content. Sn and Mn increase the part of the cubic-space-centered beta phase, Ni stabilizes the part of the cubic-surface-centered copper-zinc mixed crystals.

Sn below 0.01% would not be advantageous since the amount of beta phase would be too low, Sn above 2% would influence the cold-forming ability.

Mn below 0.01% would not be advantageous since the beta phase would then exist in amounts which would be too small. Mn above 0.3% would influence the forming ability and the resistance to stress corrosion cracking.

Ni below 0.01% would not be sufficient to sufficiently stabilize the copper mixed crystal, in addition the favorable effect on the resistance to a surface-like corrosion attack would be eliminated. Ni above 0.3% would lead to an increased solidification during cold forming and would therefore not be advantageous.

Fe or Co is necessary in order to control the grain size of the alpha phase. The action would not exist sufficiently below 0.01%. The danger of rough precipitations would exist above 0.3%, even together with Si. These would be disadvantageous for the cold forming.

The characteristic of the new material is that its energy absorbed in a Charpy notched impact test determined according to EN 10045 can be placed at room temperature between the one of Pb-containing and Pb-free brass, whereas it reaches at temperatures of above 600° C., the level of Pb-free brass types.

P is selectively provided in order to favorably influence the formation of the initial cast structure and the corrosion characteristics. Phosphor increases the flowing ability of the melt and acts favorably against the susceptibility of stress corrosion cracking.

In particular, starting with an amount of 0.003%, these effects are significant. Above 0.1%, however, the disadvantages would be predominant due to an increased tendency for intercrystalline corrosion at grain boundaries.

It is optional to add up to 0.5% aluminum by alloying in order to enable the creation of starting layers. This is particularly advantageous for decorative purposes. This effect is particularly significant starting with an amount of 0.003%. Amounts above 0.5% would no longer be advantageous for this use because the formation of a beta phase would be favored.

Partially finished products made out of the inventive material are preferably manufactured by conventional continuous casting, extrusion at temperatures of between 600° C. to 750° C. and a cold forming, for example by drawing.

The composition has proven to be able to be manufactured without any problems and has proven to be surprisingly constant in its characteristics in this manufacturing sequence. This is not the case with ternary alloys Cu—Zn—Si, as they are commonly discussed in literature. They lack the favorable characteristics in the continuous casting and a stable structure formation, which depends little on the variations of the operating parameters, for example during extrusion. This is true for both the steady course of the technological characteristic values in the finished product itself and also for the unchanged characteristics between various processed cast charges. It appears that the extent of variations of the finished round bars depends in its characteristics in the first approximation of the content of the matrix-active elements. On the basis of the majority components Cu, Zn and Si, there is the content in the sum of the matrix-active elements Sn, Fe, Co, Ni and Mn, which are at least partially soluble in the matrix, alone or in connection with the selective elements P, Ag, Al, As, Mg, Sb, Ti and Zr, obviously of a significant importance for the robust manufacture in the mill for partially finished products, which manufacture is insensitive with respect to fluctuating operating parameters.

The copper alloy consists in a preferred embodiment of 73 to 83% Cu, and 2.5 to 4% Si, the remainder being Zn and unavoidable impurities.

The copper alloy consists alternatively, and in a further preferred embodiment, of 73 to 78% Cu, and 3 to 3.5% Si, the remainder being Zn and unavoidable impurities.

The copper alloy consists alternatively, and in a further preferred embodiment, of 70 to 81% Cu and 1.5 to 2% Si, the remainder being Zn and unavoidable impurities.

The copper alloy consists alternatively, and in a further preferred embodiment, of 73 to 83% Cu and 2.0 to 2.5% Si, the remainder being Zn and unavoidable impurities.

All of the above-mentioned preferred embodiments contain phosphor in order to, in particular, favorably influence the creation of the initial cast structure and the corrosion characteristics. These alloy compositions with an amount of 0.02 to 0.05% P meet in a particularly favorable manner the expectations placed on the material.

It appears that with the contents of the matrix-active elements, except for Cu, Zn and Si, below a certain amount, such large dispersions of technological characteristics occur that this has a lasting effect on the manufacture and, in the extreme case, a safe control of the production process is not possible. In order to counteract this, 0.5 to 3% of the total content of the further matrix-active and the selectively added elements is advantageously in the copper alloy.

The dispersion is already clearly reduced at these amounts and finds its optimum in many standard processes in a particularly preferred embodiment with a total content of between 0.7 to 1%.

Depending on the process it can, however, also be sensible to instead supply a high amount of matrix-active elements. The practicability exists, however, only up to a total content of 3% at a maximum. However, no practically meaningful improvements of the dispersions can be observed beyond the content of 3% since considerable unpredictable superposed additive effects are noticed, which ruin the intended purpose.

The copper alloy is advantageously utilized for contacts, pins or fastening elements in electrical engineering, for example as stationary contacts or solid-state contacts, part of which are also clamping joints and plug connectors or connector contacts.

The alloy has, compared with liquidy and gaseous media, a high corrosion resistance. In addition, it is extremely resistant to dezincing and stress corrosion cracking. Consequently, the alloy is advantageously suited for use in containers for the transport or storage of liquids or gases, in particular, containers in the field of refrigeration technology or for tubes, water fittings, faucet extensions, pipe joints and valves in the field of sanitation technology.

The low corrosion rates guarantee also that the negligence regarding the metal, that is the characteristic of removal through the action of liquidy or gaseous media of alloy components, is actually low. In this respect, the material is suited for areas of use which demand the low emission of contaminants in order to protect the environment. Thus, the use of the inventive alloy lies advantageously in the field of recyclable components.

The insensitivity with respect to stress corrosion cracking suggests the use of the alloy in screw connections or clamping joints, where, technically caused, high elastic energies are stored. Thus, particularly advantageous is the use of the alloy for all tensile-stressed and/or torsion-stressed components, in particular, for screws and nuts. The inventive material reaches, after cold forming, higher values for the yield strength than Pb-containing CuZn alloys. Thus, it is possible to realize in screw connections, which may not plastically deform, greater tightening torques. The apparent yielding point ratio $R_{p0.2}/R_m$ is smaller for the CuZnSi alloy than in free-cutting brass. Screw connections, which are only tightened once and are thereby intentionally over-stressed, achieve with this particularly high retention forces. Because of the higher strength level, savings in weight of at least 10% are possible through a miniaturization.

The inventive alloy shows a distinctive temperature dependency of the impact tenacity. The impact tenacity drops at temperatures of above 600° C. to values which correspond to those of some Pb-containing alloys and promise an advantageous use for die-formed parts.

Possibilities for use of the copper alloy result both for tube-shaped and also strip-shaped starting materials. Advantageously, easily millable or punchable strips, sheet metal and plates are suited in particular for keys, engravings, decorative purposes or for pressed-screen applications. For manufacture, a conventional continuous casting is preferred, hot rolling between 600 to 900° C. with a subsequent forming, as for example, cold rolling, and, if needed, supplemented by further annealing and forming steps, to form suitable partially finished strip products. The alloy can be utilized as a malleable, rolling or casting alloy.

The advantages achieved with the invention consists in particular in these having a good cutting property and good forming ability in connection with a high corrosion resistance. The resistance to dezincing and stress corrosion cracking is hereby especially distinctive.

In addition, toxic elements are absent which, due to increasingly stricter standards for protecting the environment, enable a free use, in particular in connection with drinking-water systems.

A further important advantage is an increased strength level with an equally high ductility compared to lead-containing machinable brass.

Narrow manufacturing tolerances play an important role in the manufacture of the alloy. Particularly advantageous in the inventive alloy is its suitability for the mass production in the mill for partially finished products with respect to a robust manufacture, namely a manufacture insensitive to fluctuating operating parameters.

FIG. 1 illustrates the relationship between the standard deviation of the product characteristics and the content of matrix-active elements without the major components. The curve shows the to be expected trend for the standard deviation without consideration of further effects. Thus, it appears that in the case of the content of the matrix-active elements, except for Cu, Zn and Si, the dispersions of the technological characteristics decrease asymptotically over a certain part, from which the conclusion results that an as high as possible part of the matrix-active elements is to be supplied. However, practice shows that the desired material characteristics occur only up to a total content of 3% at a maximum. Above the content of 3%, no further improvements of the dispersions can be observed since considerable unpredictable superposed additive effects are observed, which do not lead to any further improvement.

The variability of the material characteristics which, through use of the inventive composition, move particularly into the foreground, are the apparent yielding point, the tensile strength, the ductile yield, the hardness, the grain size and the hardening ability of the material. During the further course of the processing through cold forming and annealing, if desired, the corresponding observations are made.

An example follows which deals with the manufacture and the characteristics of semi-finished products made out of the inventive Si-containing high-strength brass.

Two cylindrical bolts, Ø 150 mm×300 mm, were manufactured via chill casting. Bolt 1 had the composition of 73.63% Cu, 23.37% Zn, 2.94% Si, 0.01% Sn, 0.02% Fe, 0.01% Ni, 0.01% Mn, 0.006% P. Bolt 2 had the composition of 76.65% Cu, 20.04% Zn, 3.27% Si, 0.01% Sn, 0.01% Fe, 0.01% Ni, 0.01% Mn, 0.003% P. The bolts were formed at 700° C., through extrusion, into round bars, Ø 21.5 mm. After a surface treatment via etching in sulfuric acid and hydrogen peroxide, cold forming through drawing to the end dimension Ø 20 mm occurred.

The following table shows as an example some characteristics for use of the Si-containing high-strength brass in comparison to semi-finished products made out of CuZn37 and CuZn39Pb3, which were manufactured in a comparable manner.

The example shows that a reduction of the Cu content results in the material clearly becoming brittle. The copper concentration is approximately 3% less in bolt 1 than in bolt 2. The result is a corresponding decrease of the ductile yield. The inventive advantageous characteristics of the alloy are no longer achieved upon a further lowering of the Cu part under a value of 70%.

| | Billet 1 | Billet 2 | CuZn39Pb3 | CuZn37 |
|---|---|---|---|---|
| State | Round bar 7% drawn | Round bar 7% drawn | Round bar 7% drawn | Round Bar 7% drawn |
| Yield Strength $R_{p0.2}$ | 421 MPa | 412 MPa | 335 MPa | 300 MPa |
| Tensile Strength $R_m$ | 641 MPa | 697 MPa | 475 MPa | 425 MPa |

-continued

| | Billet 1 | Billet 2 | CuZn39Pb3 | CuZn37 |
|---|---|---|---|---|
| $R_{p0.2}/R_m$ | 0.7 | 0.6 | 0.7 | 0.7 |
| Ductile Yield $A_{10}$ | 6% | 26% | 18% | 32% |
| SRK4-Test according to DIN 50916T1 (on a turned piece manufactured out of the bar-see Picture 1) | — | no cracks | cracks | cracks |
| Maximum dezincing depth | — | 165 μm | 1200 μm | 750 μm |
| Chip form during tough-working (large $a_p$- and f-values) | — | dis-continuous chips | dis-continuous chips | short helical chips |
| Chip form during smoothing (small $a_p$- and f-values) | — | dis-continuous chips | dis-continuous chips | snarl chips |

The tensile strength of the round bars, which were manufactured out of the copper-rich and silicon-rich bolt 2, is clearly higher than in the case of the comparison materials. The ductile yield value lies between those of CuZn39Pb3 and CuZn37; the corrosion resistance is the highest in the Si-containing material, during machining of the same, favorable chip forms accumulate as in the case of Pb-containing free-cutting brass.

Figure 2:
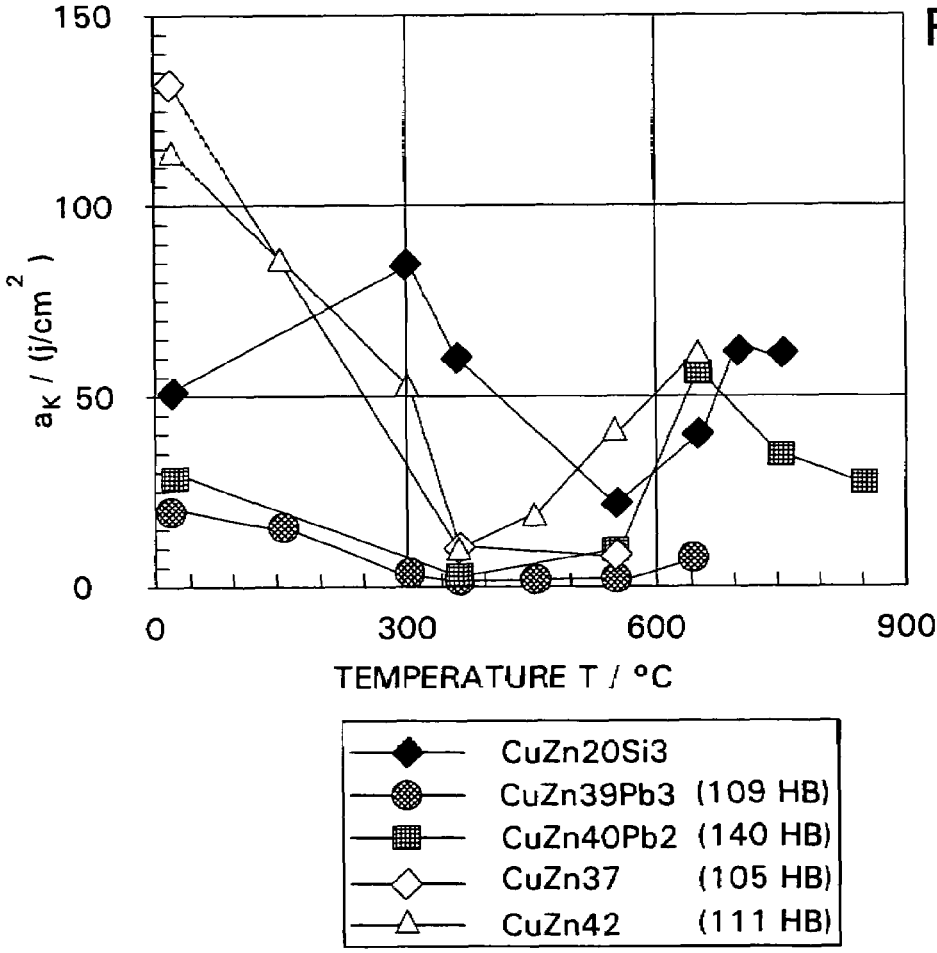
FIG. 2 illustrates the energy absorbed in a Charpy notched impact test $a_k$ in dependency of the temperature for the inventive alloys and Pb-containing alloys of the state of the art.

The bars resulting from the bolts 2 were utilized for impact bending tests. FIG. 2 illustrates the energy absorbed in a Charpy notched impact test $a_k$ in dependency of the temperature for the inventive alloys and Pb-containing alloys of the state of the art.

FIG. 2 illustrates, for comparison purposes also, Pb-free and Pb-containing brass types. Among the last-mentioned is also the classic hot working brass CuZn40Pb2. The $a_k$ values lie at low temperatures below the ones of the Pb-free CuZn alloys. This correlates with the comparatively favorable chip forms of the inventive alloy. The impact bending tenacity reaches at temperatures of above 600° C. the values of the Pb-free alloy. Accordingly the Si-containing alloys are suited also for the manufacture of complex die-formed parts.

What is claimed is:

1. A copper alloy consisting of, in weight %:
73-83% Cu;
2.5-4% Si;
0.01-2% Sn;
0.01-0.3% Fe and/or Co;
0.01-0.3% Ni;
0.01-0.3% Mn;
up to 0.1% P;
up to 0.5% of each of Ag, As, Mg, Sb, Ti and Zr; and the remainder being zinc and unavoidable impurities.

2. The copper alloy of claim 1, wherein the alloy contains 73-78% Cu and 3-3.5% Si.

3. The copper alloy of claim 1, wherein the alloy contains 0.02-0.05% P.

4. The copper alloy of claim 1, wherein the total content of Sn, Fe and/or Co, Ni, Mn, P, Ag, As, Mg, Sb, Ti and Zr is from 0.5-3%.

5. The copper alloy of claim 1, wherein the total content of Sn, Fe and/or Co, Ni, Mn, P, Ag, As, Mg, Sb, Ti and Zr is from 0.7-1%.

6. A method of manufacturing a contact, pin or fastening element utilized in electrical engineering in which the improvement comprises a step of manufacturing said contact, pin or fastening element from the copper alloy of claim 1.

7. A method of manufacturing containers utilized for the transport of gases or liquids or for pipes, water fixtures, faucet extensions, pipe joints and valves utilized in sanitation processes in which the improvement comprises a step of manufacturing said container or pipes, water fixtures, faucet extensions, pipe joints and valves from the alloy of claim 1.

8. The method of claim 7, wherein said alloy is used in the manufacture of containers utilized in refrigeration engineering.

9. A method of manufacturing a tensile- or torsion-stressed component in which the improvement comprises a step of manufacturing said tensile- or torsion-stressed component from the alloy of claim 1.

10. The method of claim 9, wherein said alloy is used in the manufacture of screws and nuts.

11. A method of manufacturing a recyclable component having a low contaminant emission in which the improvement comprises a step of manufacturing said recyclable component from the alloy of claim 1.

12. A method of manufacturing die-formed parts in which the improvement comprises a step of manufacturing said die-formed parts from the alloy of claim 1.

13. A method of manufacturing easily millable or punchable bands, sheet metal and plates in which the improvement comprises a step of manufacturing said easily millable or punchable bands, sheet metal and plates from the alloy of claim 1.

14. A method of manufacturing a malleable, rolling or testing alloy in which the improvement comprises a step of manufacturing said malleable, rolling or casting alloy from the alloy of claim 1.

* * * * *